US006375027B1

(12) United States Patent
Thomas et al.

(10) Patent No.: US 6,375,027 B1
(45) Date of Patent: Apr. 23, 2002

(54) HOLDER FOR BLOOD SAMPLE TUBES

(76) Inventors: Harvey M. Thomas; Evelina F. Thomas, both of P.O. Box 706, Burson, CA (US) 95225

( * ) Notice: Subject to any disclaimer, the term of this patent is extended or adjusted under 35 U.S.C. 154(b) by 0 days.

(21) Appl. No.: 09/714,236

(22) Filed: Nov. 16, 2000

Related U.S. Application Data

(60) Provisional application No. 60/166,546, filed on Nov. 18, 1999.

(51) Int. Cl.[7] ..... B65D 21/02

(52) U.S. Cl. ..... 220/23.83; 220/23.88; 220/23.86

(58) Field of Search ..... 220/23.88, 507, 220/23.83, 23.86, 23.4; 206/443; 422/104

(56) References Cited

U.S. PATENT DOCUMENTS 3,474,913 A * 10/1969 Junger et al. ..... 220/23.83
3,593,873 A * 7/1971 Vonk ..... 220/507
4,032,066 A * 6/1977 Wright ..... 220/23.88
4,278,176 A * 7/1981 Adams ..... 206/443
4,510,119 A * 4/1985 Hevey
5,128,105 A * 7/1992 Berthold et al. ..... 422/102
5,651,941 A * 7/1997 Stark et al.

* cited by examiner

*Primary Examiner*—Stephen Castellano
(74) *Attorney, Agent, or Firm*—Ted Masters

(57) ABSTRACT

A holder (20) for blood sample tubes (500), includes a body (20) having a first end (24) and a longitudinal axis (27). Body (22) has a plurality of cavities (28) which are oriented substantially parallel to longitudinal axis (27), each cavity (28) is sized to closely accept one blood sample tube (500). Body (22) is shaped and dimensioned for grasping by a human hand (502). Body (22) has a guard (30) at first end (24) to protect the using medical technician from needle sticks. In a preferred embodiment, the plurality of cavities (28) includes at least one outer cavity (28) which defines an elongated open slit (32) in body (22), so that when a blood sample tube (500) is inserted into outer cavity (28), blood sample tube (500) protrudes slightly outside body (22).

10 Claims, 5 Drawing Sheets

HOLDER FOR BLOOD SAMPLE TUBES

CROSS REFERENCE TO RELATED APPLICATION

This application claims the filing benefit under 35 U.S.C. §119(e) of U.S. Provisional Application No. 60/166,546, filed Nov. 18, 1999, which is included herein by reference.

TECHNICAL FIELD

The present invention is generally directed to the collection and processing of blood samples, and in particular to a device which holds a plurality of blood sample tubes in a manner which both protects the using medical technician from needle sticks, and provides for direct gripping of the blood sample tubes.

BACKGROUND

In a blood bank, units of blood obtained from donors are screened and placed into inventory. The inventory is maintained for area hospitals and in case of emergencies. The procedure for drawing a unit of blood is relatively simple. Each donor is screened for eligibility and asked to sign for consent. The donors arm is cleansed with an iodine solution and a large bore needle is inserted into the vein. When blood collection is completed the needle is removed from the donor's arm and placed into 1 of 4 sample tubes. The needle must be inserted into each sample tube, the tube filled and the needle removed. This procedure is repeated until all sample tubes are filled. The potential for a needle stick injury is very high. The medical technician performing the above procedure is exposed to all blood borne viruses, (AIDS, HIV, Syphilis, and all types of Hepatitis, etc.). These viruses have no cure and most are deadly. There two types of hand protection devices available to employees of the blood bank.

The first device is a flat square made of a hard plastic material with two openings in the center. The sample tubes are inserted into the openings until the rubber stoppers are in contact with the device surface. A finger is placed between the tubes under the plastic shield for stabilization of the tubes and to facilitate needle insertion and removal. Each tube is filled and removed until all samples are taken. This device is prone to mishaps wherein the sample tube is broken thereby covering the medical technician, work surface, and flooring with both blood and broken glass. In summary, this device is unsafe and impractical to use.

The second device is a hollow, plastic cylinder with a 2-inch circular, flat collar on top. There is a small opening in the center of the collar to facilitate the needle. The sample tube is inserted into the hollow end; the needle is inserted through the center opening and into the rubber stopper atop the tube. Each tube is then filled with blood. The small plastic collar is to protect the user from needle stick injuries. Often there are drops of blood on the end of the needle and when inserted into the device the drops smear the inside surface thus contaminating the sample tubes. The blood smears on tubes cannot be completely removed due to absorption by the paper label on the tube. This device does not provide adequate hand protection and by default exposes others to the contaminated tubes.

DISCLOSURE OF INVENTION

The present invention is directed to a holder for blood sample tubes which overcomes the disadvantages of prior art devices. The holder of the present invention affords the using medical technician protection against needle sticks, and also provides means for holding the blood sample tubes firmly in place within the holder.

Purpose—The present invention is held in the hand, will hold blood sample tubes, protect against needle sticks, allow the using medical technician to maintain contact with the blood sample tubes (to facilitate needle removal) and virtually stop blood exposure to the using technician.

Use—The invention is used to hold blood sample tubes for filling and protect the user from needle stick injuries.

Advantages—The present invention can hold 1–5 blood sample tubes, saving time by not having to lay down and pick up each tube individually, it also keeps the donor's blood sample tubes together, cutting down on the chances of mixing up donor blood sample tubes. The cut away sides of the invention's handle allow the user to maintain a constant pressure on the blood sample tubes, facilitating needle removal from the blood sample tube. The invention can be cleaned in a bleach solution without damaging the material. The present invention, when used correctly, can prevent the spread of blood born diseases acquired by needle stick injury.

In accordance with a preferred embodiment of the invention, a holder for blood sample tubes comprises a body having a guard at a first end, and a longitudinal axis. The body has a plurality of tube-receiving cavities which are oriented substantially parallel to the longitudinal axis, each cavity is sized to closely accept one blood sample tube. The body is shaped and dimensioned for grasping by a human hand.

In accordance with another preferred embodiment of the invention, the plurality of cavities includes at least one outer cavity which defines an elongated open slit or cut away section in the body, so that when a blood sample tube is inserted into the outer cavity, the blood sample tube protrudes slightly outside the body and may be abutted by the grasping hand.

In accordance with an important aspect of the invention, the plurality of cavities includes five cavities arranged in a cross-shaped pattern comprising four outer cavities and one inner cavity.

In accordance with an important feature of the invention, the first end of the body is chamfered, so that the open slit does not fully extend to the guard. This results in a longer top portion of the outer cavities which are fully cylindrical in shape, thereby affording greater protection to the hand of the medical technician in the event a needle is inadvertently inserted between the tube and the wall of the cavity.

Other features and advantages of the present invention will become apparent from the following detailed description, taken in conjunction with the accompanying drawings, which illustrate, by way of example, the principles of the invention.

MODES FOR CARRYING OUT THE INVENTION

Figure 1:
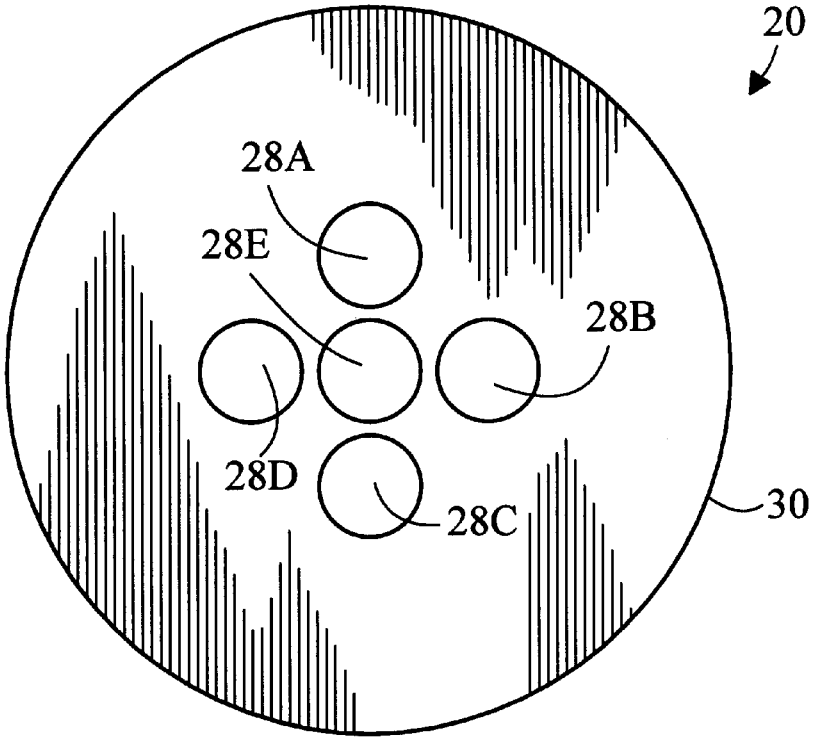
FIG. 1 is a top plan view of a holder for blood sample tubes in accordance with the present invention.
Figure 2:
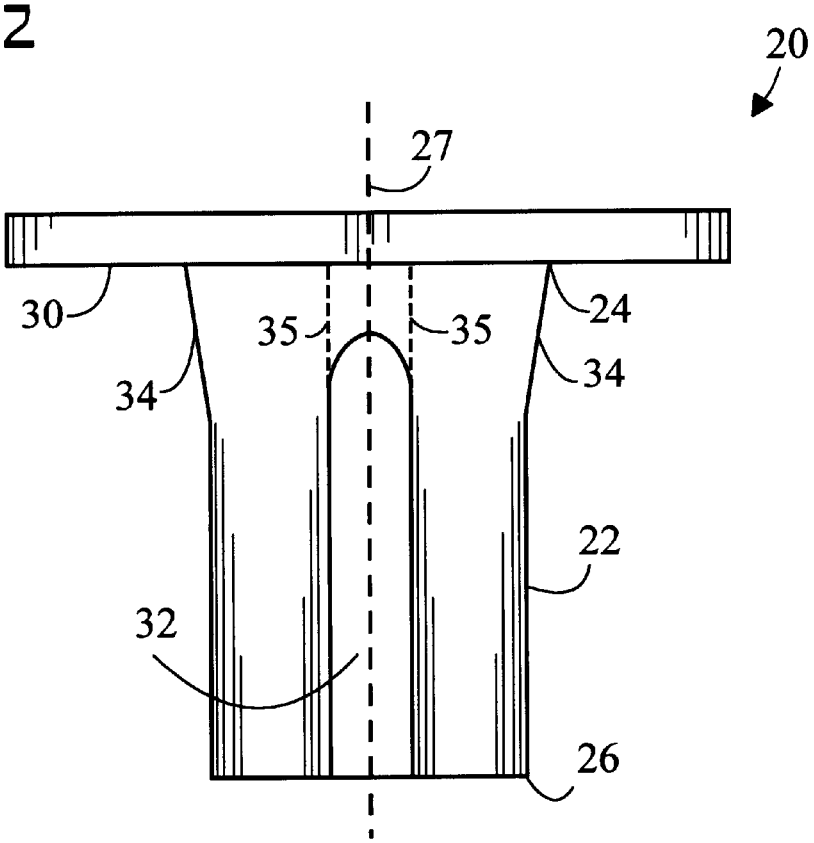
FIG. 2 is a side elevation view of the holder.
Figure 3:
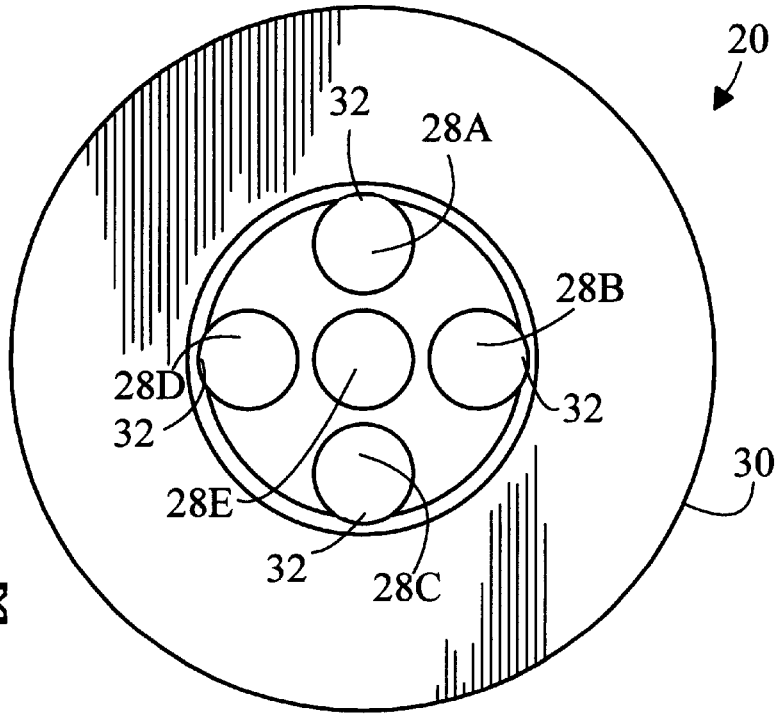
FIG. 3 is a bottom plan view.
Figure 4:
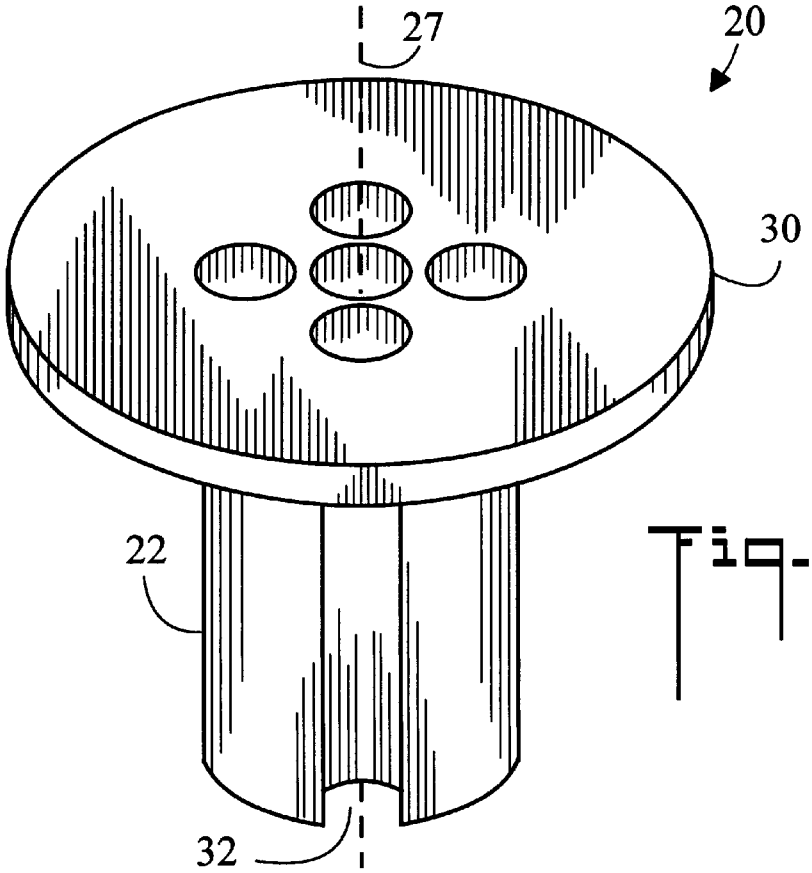
FIG. 4 is a perspective view.

Referring initially to FIGS. 1–4, there are illustrated top plan, side elevation, bottom plan, and perspective views respectively of a holder for blood sample tubes in accordance with the present invention, generally designated as 20. Holder 20 includes and elongated body 22 having a first end 24, an opposite second end 26, and a longitudinal axis 27. Body 22 has a plurality of substantially parallel cylindrical cavities 28A through 28E which are oriented substantially parallel to longitudinal axis 27. Each cavity is sized to closely accept one cylindrical blood sample tube 500 (refer to FIG. 5). Body 22 has a disc-shaped guard 30 at first end 24 to protect the hand of the medical technician when a needle is inserted into the top of blood sample tube 500. Body 22 is shaped and dimensioned for grasping by a human hand 502 (refer to FIG. 10).

In a preferred embodiment five cavities 28A through 28E are arranged in a cross-shaped pattern comprising four outer cavities 28A through 28D and one inner cavity 28E. Four outer cavities 28A through 28D each define an elongated open slit 32 in body 22, so that when a blood sample tube 500 is inserted into outer cavity 28A through 28D, the blood sample tube 500 protrudes a distance D slightly outside body 22. Then, when body 22 of holder 20 is grasped by the hand 502 of a medical technician, the technician grasps and exerts pressure on the outer sides of blood sample tubes 500 thereby holding them in place within holder 20 (refer also to FIGS. 6 and 9). This feature is particularly useful when a needle is being removed from the blood sample tube 500. If the protruding portion of blood sample tube 500 could not be positively engaged by the medical technician, upon needle withdrawal the tube would tend to follow the needle out of holder 20. Also in a preferred embodiment, first end 24 of body 22 is chamfered (portion 34), which abuts guard 30, so that open slit 32 does not fully extend to guard 30. Dashed lines 35 show how slit 32 would extend to guard 30 in the absence of chamfered portion 34. Chamfered portion 34 provides protection to the using medical technician should a needle be inadvertently inserted between the blood sample tube 500 and the wall of outer cavities 28A through 28D.

Figure 5:
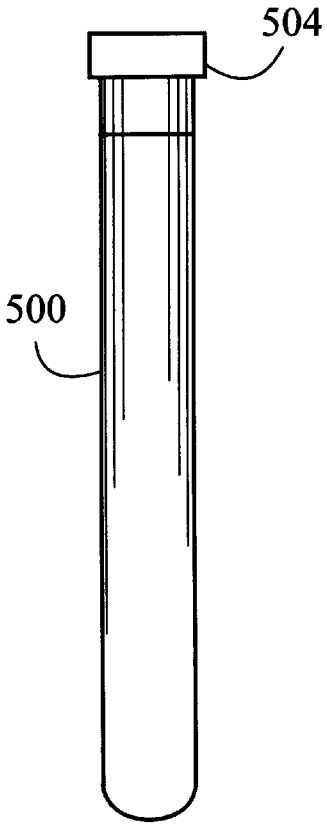
FIG. 5 is a side elevation view of a blood sample tube.

FIG. 5 is a side elevation view of a cylindrical blood sample tube 500 having an enlarged rubber head portion 504, which is in reality the outer part of a stopper which closes blood sample tube 500.

Figure 6:
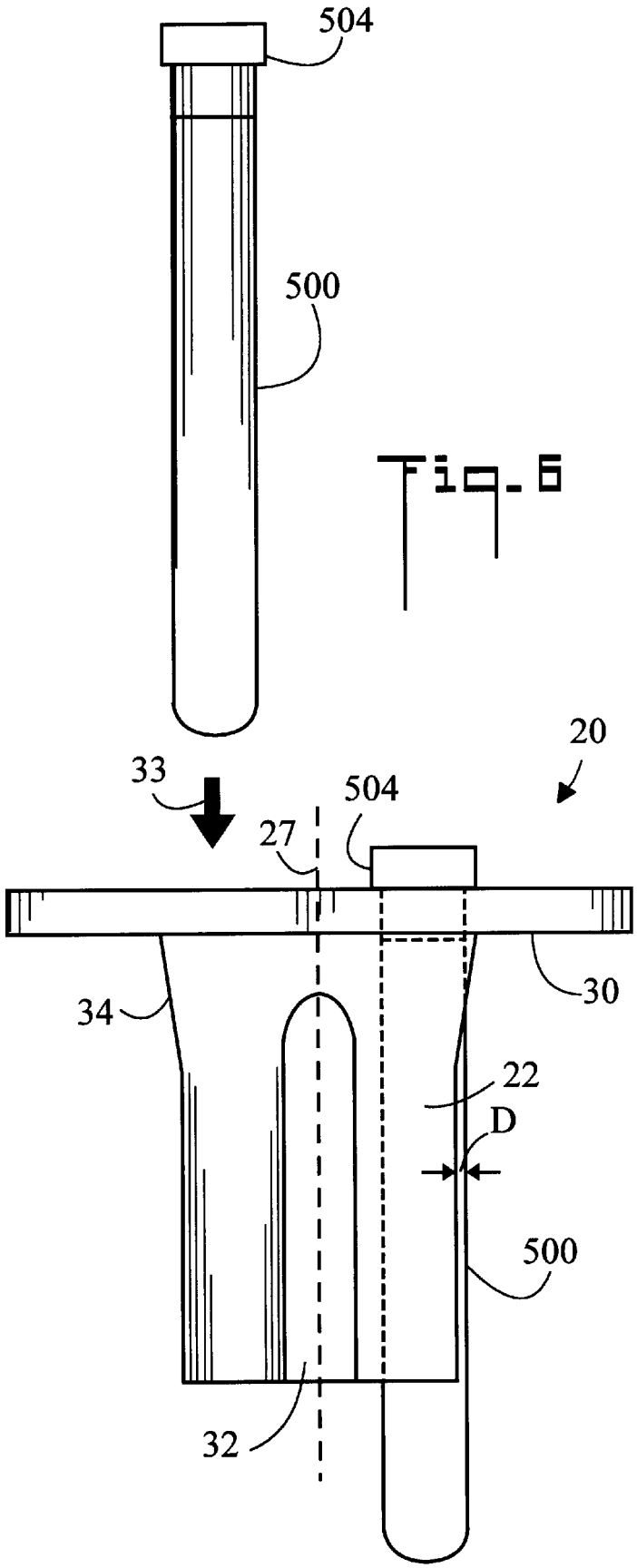
FIG. 6 is a side elevation view showing how blood sample tubes are inserted into the holder.

FIG. 6 is a side elevation view showing how blood sample tubes 500 are inserted into holder 20 from the guard 30 side. One blood sample tube 500 is in holder 20, and another is being inserted in direction 33. It is noted that the inserted blood sample tube 500 protrudes a distance D outside of body 22 so that when a medical technician grasps body 22 of holder 20, he or she will grasp the outside portion of blood sample tube 500 thereby holding it in place within holder 20.

Figure 7:
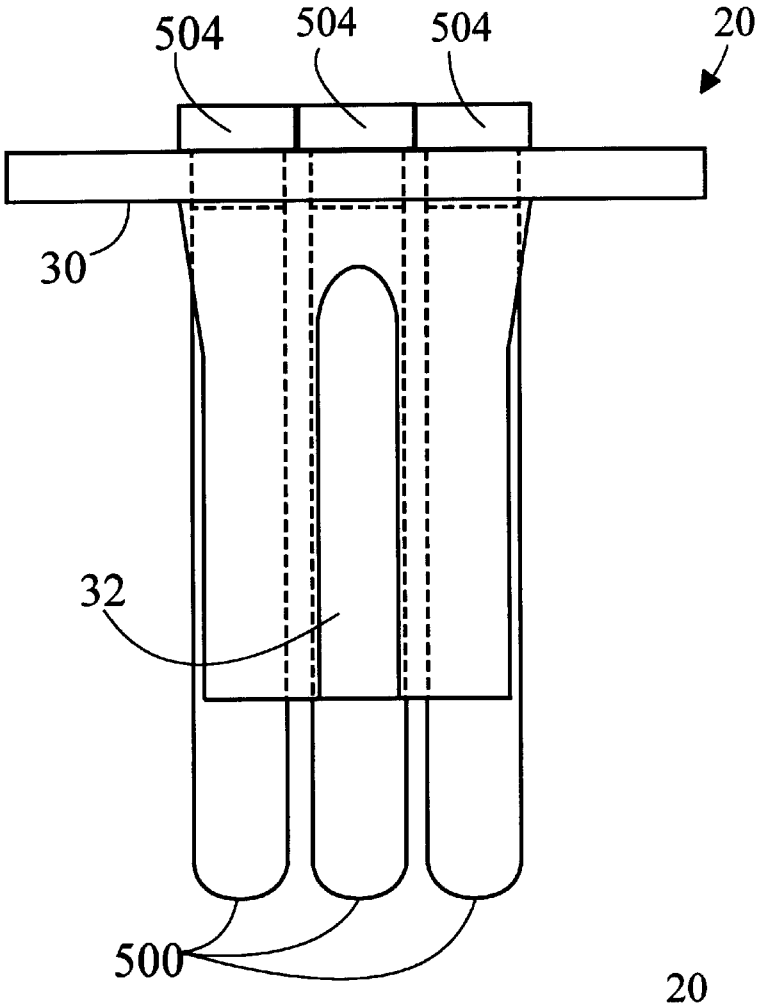
FIG. 7 is a side elevation view showing a plurality of blood sample tubes inserted into the holder.

FIG. 7 is a side elevation view showing a plurality of blood sample tubes 500 inserted into holder 20. It is noted that blood sample tubes 500 are inserted from the guard 30 side, and the head portion 504 prevents the blood sample tube 500 from passing through holder 20.

Figure 8:
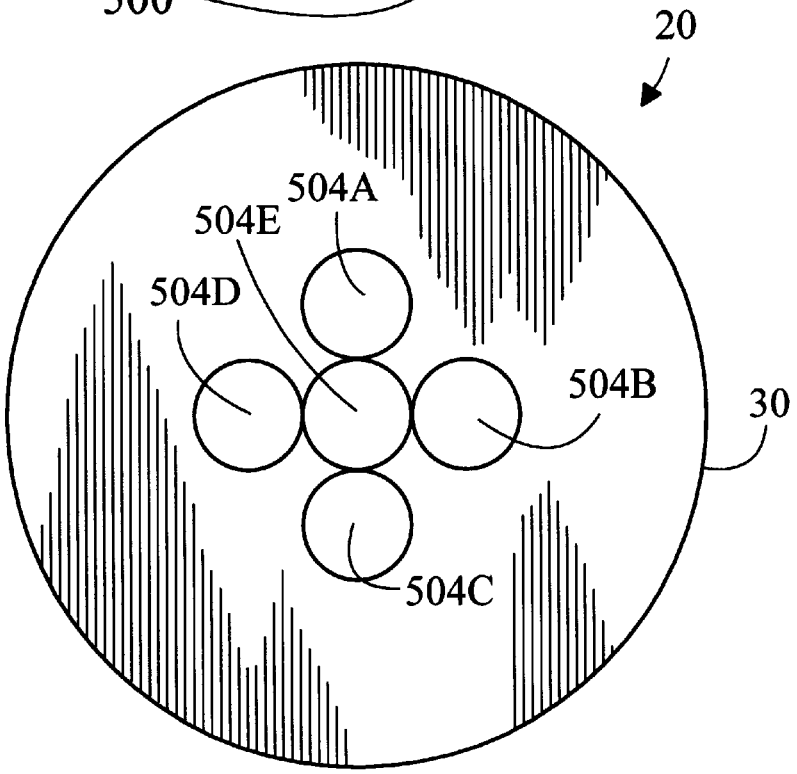
FIG. 8 is a top plan view showing the plurality of blood sample tubes inserted into the holder.

FIG. 8 is a top plan view showing the plurality of blood sample tubes 500 inserted into holder 20. It is noted that the head portions 504 of the four outer blood sample tubes 500, abut and hold the head portion 504 of the inner blood sample tube 500 in place within holder 20.

Figure 9:
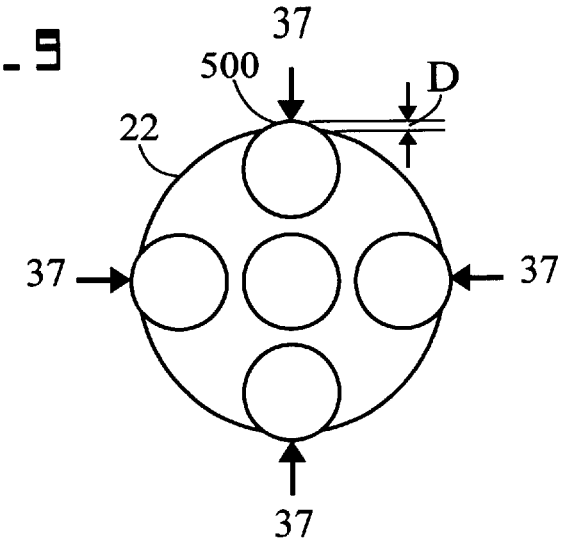
FIG. 9 is a bottom plan view showing how the blood sample tubes extend beyond the body of the holder; and, FIG. 10 is a perspective view of a medical technician grasping the holder and the sample tubes.

FIG. 9 is a bottom plan view showing how the blood sample tubes 500 extend a distance D beyond body 22 of holder 20. When a medical technician grasps body 22 of holder 20, he or she also grasps the protruding portion of blood sample tubes 500 and therefore applies pressure in directions 37 to hold the blood sample tubes 500 in place within holder 20.

Figure 10:
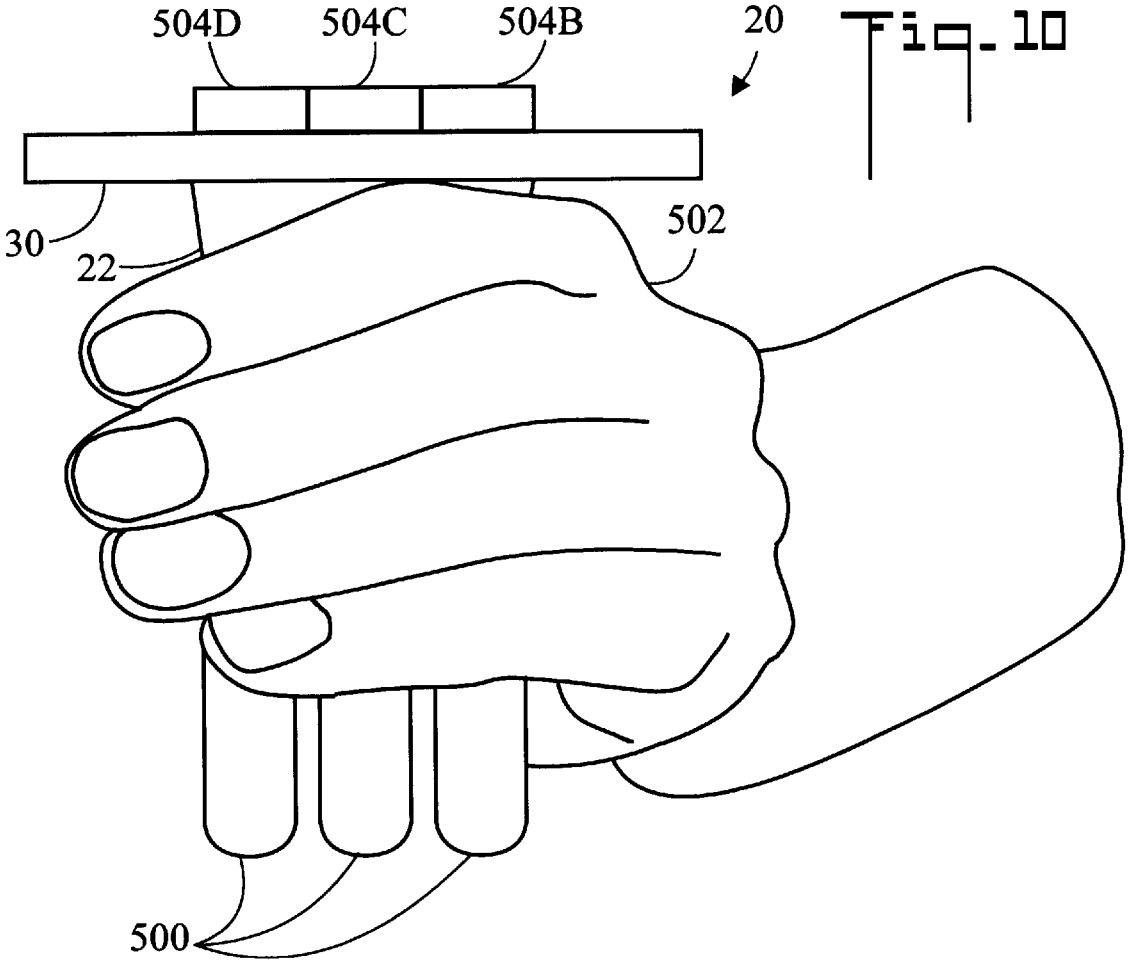

FIG. 10 is a perspective view of a medical technician grasping holder 20 and inserted blood sample tubes 500 in hand 502.

In terms of use, a method for handling blood sample tubes 500, comprises:

providing a holder 20 for blood sample tubes 500, the holder 20 having a plurality of tube receiving cavities 28 and a body 22;

providing at least one blood sample tube 500;

inserting the at least one blood sample tube 500 into one cavity 28 of holder 20; and, grasping the body 22 of holder 20.

In a preferred embodiment, the method also includes:

the plurality of tube receiving cavities 28 including at least one outer cavity 28 which defines an elongated open slit 32 in body 22, so that when the blood sample tube 500 is inserted into outer cavity 28, the blood sample tube 500 protrudes slightly outside body 22; and, the step of inserting including inserting at least one blood sample tube 500 into the at least one outer cavity 28; and, the step of grasping including grasping the protruding portion of the blood sample tube 500 inserted in outer cavity 28.

Testing Results—The present invention has been extensively tested, and found highly useful in providing protection from a needle. It is virtually impossible to be stuck with the needle, and filling the blood sample tubes 500 is easier and takes less time. Using the present invention has resulted in no blood sample tubes 500 being broken, blood spilled, or needle sticks. Without the present invention, several close encounters with the needle have been experienced.

The preferred embodiments of the invention described herein are exemplary and numerous modifications, dimensional variations, and rearrangements can be readily envisioned to achieve an equivalent result, all of which are intended to be embraced within the scope of the appended claims.

We claim:

1. A holder for a plurality of blood sample tubes, said holder for protecting a hand of a medical technician from an inadvertent needle stick when the medical technician attempts to insert the needle into the top of a blood sample tube, said holder comprising:

a body shaped and dimensioned for grasping by one hand of the medical technician, said body having a first end and a central axis;

said body having a plurality of parallel cavities, each said cavity shaped and dimensioned for accepting one blood sample tube, all said cavities being of a same size;

a guard connected to said first end, said guard having a plurality of holes which align with said plurality of cavities, so that the blood sample tube may be inserted into one of said holes in said guard, and pass through said guard into one of said plurality of cavities, wherein after insertion of the blood sample tube said guard is disposed between the top of the blood sample tube and said body;

said guard extending radially outward in all directions from said central axis a distance greater than said body extends outward from said central axis, so that when said body is grasped by the hand of the medical technician said guard forms a barrier between the hand of the medical technician and the top of the blood sample tube, thereby protecting the hand of the medical technician from an inadvertent needle stick when the medical technician attempts to insert the needle into the top of the blood tube;

said plurality of cavities in said body including at least one inner cavity and a plurality of outer cavities each said outer cavity defining an elongated open slit in said body parallel to said central axis, said at least one inner cavity not having an elongated open slit;

wherein when blood sample tubes are inserted into said outer cavities, a portion of each blood sample tube protrudes slightly outside said slit; and, wherein said body may be grasped and geld by only one hand of the medical techician, the hand surrounding all the tubes and applying prassure simultaneously to the protruding portions of all the blood sample tubes in a radial direction toward said central axis of said body, thereby holding the blood sample tubes in place within said holder.

2. A holder according to claim 1, further including:

said guard being planar shaped.

3. A holder according to claim 2, further including:

said guard being disc-shaped.

4. A holder according to claim 2, further including:

said guard being substantially perpendicular to said central axis of said body.

5. A holder according to claim 1, further including:

said guard extending outward from said central axis about twice as far as said body extends outward from said central axis.

6. A holder according to claim 1, further including:

said body having a length; and, said elongated open slit having a length greater than one half said length of said body.

7. A holder according to claim 1, further including:

said plurality of cavities including five said cavities arranged in a cross-shaped pattern comprising four said outer cavities and one inner cavity.

8. A holder according to claim 1, further including:

said first end of said body being chamfered adjacent to said guard, so that said open slit does not fully extend to said guard.

9. A holder according to claim 1, further including:

said body being substantially cyclindrical.

10. A holder for a plurality of blood sample tubes, said holder for protecting the hand of a medical technician from an inadvertent needle stick when the medical technician attempts to insert the needle into the top of a blood sample tube, said holder comprising:

a body shaped and dimensioned for grasping by the hand of the medical technician, said body having a first end and a central axis;

said body having a plurality of parallel cavities, each said cavity shaped and dimensioned for accepting one blood sample tube;

a guard connected to said first end, said guard having a plurality of holes which align with said plurality of cavities, so that the blood sample tube may be inserted into one of said holes in said guard, and pass through said guard into one of said plurality of cavities, wherein after insertion of the blood sample tube said guard is disposed between the top of the blood sample tube and said body;

said guard extending radially outward in all directions from said central axis a distance greater than said body extends outwardly from said central axis, so that when said body is grasped by the hand of the medical technician said guard forms a barrier between the hand of the medical technician and the top of the blood sample tube, thereby protecting the hand of the medical technician from an inadvertent needle stick when the medical technician attempts to insert the needle into the top of the blood sample tube;

said plurality of cavities in said body including at least two outer cavities which define an elongated open slit in said body parallel to said central axis, so that when the blood sample tube is inserted into said outer cavity, the blood sample tube protrudes slightly outside said body and can be abutted by the grasping hand of the medical technician thereby holding the blood sample tube in place within said holder;

said guard being disc shaped;

said body being substantially cylindrical;

said guard being substantially perpendicular to said central axis of said body;

said guard extending outward from said central axis about twice as far as said body extends outward from said central axis;

said elongated open slit having a length greater than one half said length of said body;

said plurality of cavities including five said cavities arranged in a cross-shaped pattern comprising four said outer cavities and one inner cavity; and said first end of said body being chamfered adjacent to said guard, so that said open slit does not fully extend to said guard.

* * * * *